US006474940B1

(12) United States Patent
Yamauchi et al.

(10) Patent No.: US 6,474,940 B1
(45) Date of Patent: Nov. 5, 2002

(54) TURBO MOLECULAR PUMP

(75) Inventors: Akira Yamauchi; Hideki Enosawa, both of Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/334,308

(22) Filed: Jun. 16, 1999

(30) Foreign Application Priority Data

Jun. 17, 1998 (JP) ..... 10-170398

(51) Int. Cl.[7] ..... F01D 1/36; B63H 1/26
(52) U.S. Cl. ..... 415/90; 416/223 R; 415/199.5
(58) Field of Search ..... 415/90, 199.1, 415/199.2, 199.4, 199.5; 416/223 R, 235, 223 A

(56) References Cited

U.S. PATENT DOCUMENTS

| | | | | | |
|---|---|---|---|---|---|
| 1,539,395 | A | * | 5/1925 | Losel | 415/199.5 X |
| 2,991,929 | A | * | 7/1961 | Stalker | 415/199.5 X |
| 3,644,051 | A | * | 2/1972 | Shapiro | 415/90 |
| 3,826,588 | A | * | 7/1974 | Frank | 415/90 |
| 5,033,936 | A | * | 7/1991 | Shinojima | 415/90 |
| 5,553,998 | A | * | 9/1996 | Muhlhoff et al. | 415/90 |
| 5,611,660 | A | * | 3/1997 | Wong et al. | 415/90 |

FOREIGN PATENT DOCUMENTS

| | | |
|---|---|---|
| DE | 29715035 | 12/1997 |
| EP | 0829645 | 3/1998 |
| GB | 2052317 | 1/1981 |
| JP | 56-593 | 1/1981 |
| JP | 10-246195 | 9/1988 |
| JP | 7506648 | 7/1995 |

OTHER PUBLICATIONS

Beitz W., Kutter, K.H., "Dubbel, Taschenbuch fur den Maschinenbau", 1981, Springer–Verlag, Berlin XP002158784, p. 199, table 5A.

* cited by examiner

*Primary Examiner*—John E. Ryznic
(74) *Attorney, Agent, or Firm*—Adams & Wilks

(57) ABSTRACT

A turbo molecular pump has a rotor having rotor blades arranged in multiple stages. Each of the rotor blades has a proximal end fixed to the rotor and a distal end. Stator blades are arranged in multiple stages. Each stator blade has a proximal end and a distal end. The rotor blades and the stator blades are alternately arranged in spaced-apart relation in an axial direction so that a spatial clearance between the proximal end of each of the rotor blades and the distal end of an adjacent stator blade is smaller than a spatial clearance between the distal end of each of the rotor blades and the proximal end of the adjacent stator blade. Each of the rotor blades comprises a cantilever member having upper and lower surfaces. At least one of the upper and lower surfaces of the cantilever member is contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and $\Delta$ represents a flexure amount of the cantilever member at a distance x (mm) from the distal end of the cantilever member.

16 Claims, 15 Drawing Sheets

TURBO MOLECULAR PUMP

BACKGROUND OF THE INVENTION

1) Filed of the Invention

The present invention relates to a turbo molecular pump which is used as a vacuum apparatus of a semiconductor manufacturing apparatus or the like, and in particular to a turbo molecular pump having improved exhaust performance and high reliability.

2) Description of the Related Art

FIG. 19 shows an entire arrangement of a turbo molecular pump. In FIG. 19, a rotor 1 is axially floated by an axial electromagnet 3, and the position of the rotor 1 in a radial direction is controlled by radial electromagnets 5A and 5B. The rotor 1 is rotated by a motor 7. The rotor 1 is formed with rotor blades 9 arranged in multiple stages in the axial direction. A plurality of stator blades 11 are disposed in multiple stages to define clearances from rotor blades 9. The end of the each stator blade 11 is supported by and between a plurality of spacers 13 that are stacked one on another and integrally connected to a housing 20.

FIG. 20 shows an external view of the stator blade 11. The turbo molecular pump thus constructed performs the exhaust action in such a manner that the rotating rotor blades 9 beat gaseous molecule to move the same in the axial direction. The turbo molecular pump of this type is used, for instance, to exhaust the gas in a chamber of a semiconductor manufacturing apparatus. That is, the gas, which is always supplied to the chamber for processing of the semiconductor, is discharged therefrom by the turbo molecular pump.

FIG. 21 is an enlarged view of a portion bracketed by a dotted line in FIG. 19. In the illustrated turbo molecular pump, a clearance between the rotor blade 9 and the stator blade 11 is constant along the entire length of the rotor blade 9. In order to determine this clearance δ, a tolerance regarding a clearance between a protective ball bearing 15 and the rotor 1, the machining accuracy and assembling accuracy of the components, etc. must be taken into account. Further, the flexure of the rotor blade 9 and the stator blade 11, which is caused by the introduction of the atmospheric air under the pump operation, the externally-applied impact, the touch-down caused, for instance, by the current-cut-off, etc., must also be taken into account.

Upon the consideration of the above factors, the clearance δ must be determined to be such a dimension as to keep the rotary blade 9 and the stator blade 11 in non-contact with each other. The flexure of the rotor blade 9 is a primary factor (about 30%) to be considered for determining the clearance δ.

On the other hand, this clearance δ is closely related to the exhaust performance of the turbo molecular pump. Recent tendency is to increase the amount of the gas supplied to the chamber, and therefore the amount of the gas to be exhausted under the normal operation of the turbo molecular pump is being increased. FIG. 22 shows a test result of flow quantity characteristic.

In FIG. 22, $P_s$ is defined as a pressure at which the gas is changed from a molecular flow region to an intermediate flow region. The hatched portion in the drawing shows a degree of lowering of the performance. It can be found out from this test result that a sufficient exhaust performance was obtained in the molecular flow region in which the flow quantity of the gas to be discharged was relatively low, but the sufficient exhaust performance was not obtained if the flow quantity of the gas to be discharged is increased to reach the intermediate flow region.

The lowering of the exhaust performance in association with the increase of the gas flow quantity is in correlation with the size of the clearance δ existing between the rotor blade 9 and the stator blade 11. Whether or not the gas in the clearance between the rotor blade 9 and the stator blade 11 is handled as the molecular flow region depends on the mean free path of the gas, and this mean free path is expressed approximately by Formula 2.

[Formula 2]

$$Ps(Torr) = \frac{0.05}{\delta(\mathrm{mm})} \qquad \text{[Formula 2]}$$

That is, as the clearance δ becomes smaller, the start pressure $P_s$ of the intermediate flow region becomes higher. If the start pressure $P_s$ becomes higher, it is possible to avoid the lowering of the performance accordingly even if the flow quantity Q becomes larger.

It is, however, noted that a certain flexure is inevitably caused on the rotor blade 9 and the stator blade 11 in the case where the introduction of the atmospheric air under the pump operation, the externally-applied impact, the touch-down caused, for instance, by the current-cut-off, etc. occur. For this reason, simply making the clearance δ smaller gives rise to the likelihood of the contact between the rotor blade 9 and the stator blade 11.

SUMMARY OF THE INVENTION

The present invention was made in view of the above-noted problem encountered in the related turbo molecular pump, and an object of the present invention is to provide a turbo molecular pump which has an improved exhaust performance with its reliability maintained.

A turbo molecular pump according to the present invention comprises: a rotor having rotor blades arranged in multiple stages; and stator blades arranged in multiple stages, the rotor blades and the stator blades being alternately arranged in an axial direction with spaces therebetween, which is characterized in that a spatial clearance between a proximal end of a rotor blade and a stator blade adjacent thereto is made smaller than a spatial clearance between a distal end of the rotor blade and the stator blade.

The spatial clearance between the proximal end of the rotor blade and the distal end of the stator blade adjacent to the rotor blade is made smaller than the spatial clearance between the distal end of the rotor blade and the proximal end of the stator blade. Here, the proximal end of the rotor blade means a fixed side of the rotor blade to the rotor, i.e. an inner circumferential side. The proximal end of the stator blade means the outer circumferential side of the stator blade supported between a plurality of stator vane spacers that are stacked one on another.

Making the spatial clearance between the rotor blade and the stator blade smaller effectively enhances the exhaust performance of the turbo molecular pump. It is, however, noted that making the spatial clearance smaller results in the liability that the rotor blade may contact the stator blade. For this reason, the spatial clearance on the proximal end side of the rotor blade, which is less flexured, is set to be smaller in comparison to the spatial clearance on the distal end side of the rotor blade, which is more flexured. This arrangement makes it possible to avoid the lowering of the performance even if the flow quantity becomes larger.

The turbo molecular pump of the present invention is characterized in that at least one of upper and lower surfaces of the rotor blade and/or at least one of upper and lower surfaces of the stator blade is/are contoured to present a flexure curve line expressed by Formula 1 or approximately expressed by Formula 1 where Young's modulus of material is E (kgf/mm$^2$), a geometrical moment of inertia of a beam is I (mm$_4$), an entire length of the beam is L (mm), a distributed load on the beam is W (kgf/mm), and a flexure amount of the beam at a distance x (mm) from an open end of the beam is Δ (mm), a thickness of the rotor blade in the axial direction is thinner as it approaches the distal end of the rotor blade, and a thickness of the stator blade in the axial direction is thinner as it approaches a proximal end of the stator blade.

[Formula 1]

$$\Delta = \frac{WL^4}{8EI}\left(1 - \frac{4X}{3L} + \frac{X^4}{3L^4}\right) \quad \text{[Formula 1]}$$

The contour may be a curved configuration or otherwise may be a linear configuration, i.e. a tapered configuration. The tapered configuration can be obtained only by a plano-processing, so that it is easily available in comparison with a case in which the curved configuration is obtained by processing. Formula 1 expresses the flexure amount or deflection at an arbitrary point on the simple cantilever beam. At least one of the upper and lower surfaces of the rotor blade and/or at least one of the upper and lower surfaces of the stator blade is/are processed along the flexure curve line expressed by Formula 1 or approximately expressed by Formula 1. This makes it possible to design the spatial distance between the rotor blade and the stator blade as optimum and continuous amounts along the flexure curve line consequently, the pressure from which the intermediate flow region begins can be set as high as possible.

The turbo molecular pump of the present invention is characterized in that at least one of upper and lower surfaces of the rotor blade and/or at least one of upper and lower surfaces of the stator blade is/are provided in a stepwise manner with at least one step along a flexure curve line expressed by a formula 1 or approximately expressed by Formula 1, a thickness of the rotor blade in the axial direction is thinner in a stepwise manner as it approaches the distal end of the rotor blade, and a thickness of the stator blade in the axial direction is thinner in a stepwise manner as it approaches a proximal end of the stator blade.

At least one step is provided in the stepwise manner along the flexure curve line expressed by Formula 1 or approximately expressed by Formula 1. By providing the step or steps in the stepwise manner, the spatial clearance between the rotor blade and the stator blade can be set in the stepwise manner to make it difficult to contact the rotor blade with the stator blade. It can be formed only by the plano-processing which is easier than the curved processing.

The turbo molecular pump of the present invention is characterized in that a single step is provided at a position in a range of 60–85% from the proximal end of the rotor blade or the distal end of the stator blade.

The only one step is provided. The amount of the work as to the exhaust action of the turbo molecular pump is evaluated in order to determine an effective position at which the step should be provided on the blade. To this end, the evaluation is carried out on a certain value, which has a correlation with this amount of the work, on the basis of the clearance between the rotor blade and the stator blade obtained from the flexure curve line expressed by Formula 1 or approximately expressed by Formula 1.

The pressure, from which the lowering of the exhaust performance in the turbo molecular pump initially occurs, depends on the clearance between the rotor blade and the stator blade, and increases in an inverse-proportional manner as the clearance becomes smaller. It can be found out from the result of the evaluation that the step is disposed at a position in a range of 60–85% from the proximal end of the rotor blade or the distal end of the stator blade to enhance the exhaust performance. The provision of the single step makes the processing easy.

DETAILED DESCRIPTION OF THE PREFERRED EMBODIMENTS

Figure 1:
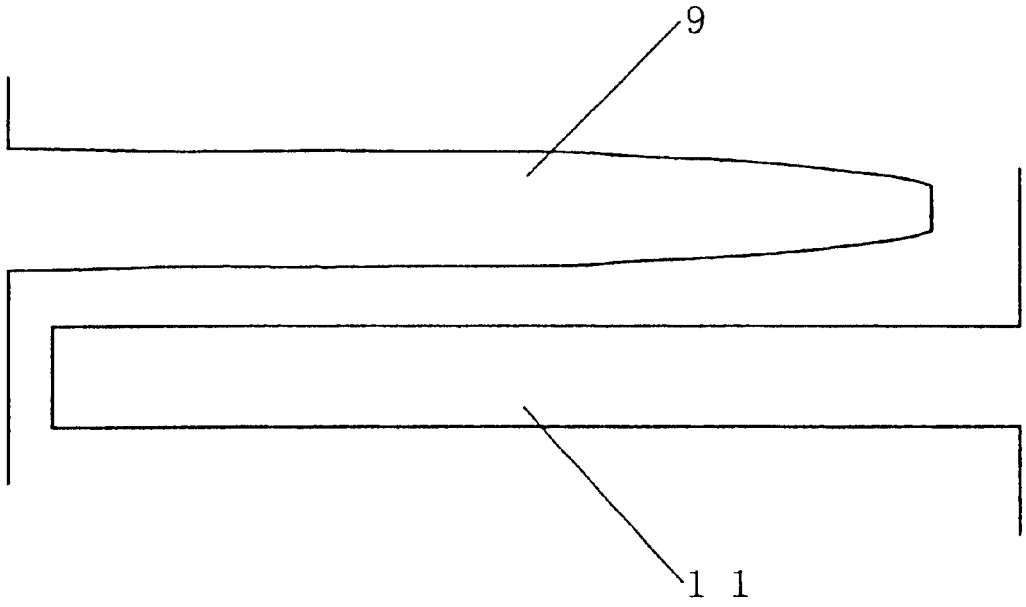
FIG. 1 is a diagram showing an arrangement of a first embodiment of the present invention.
Figure 2:
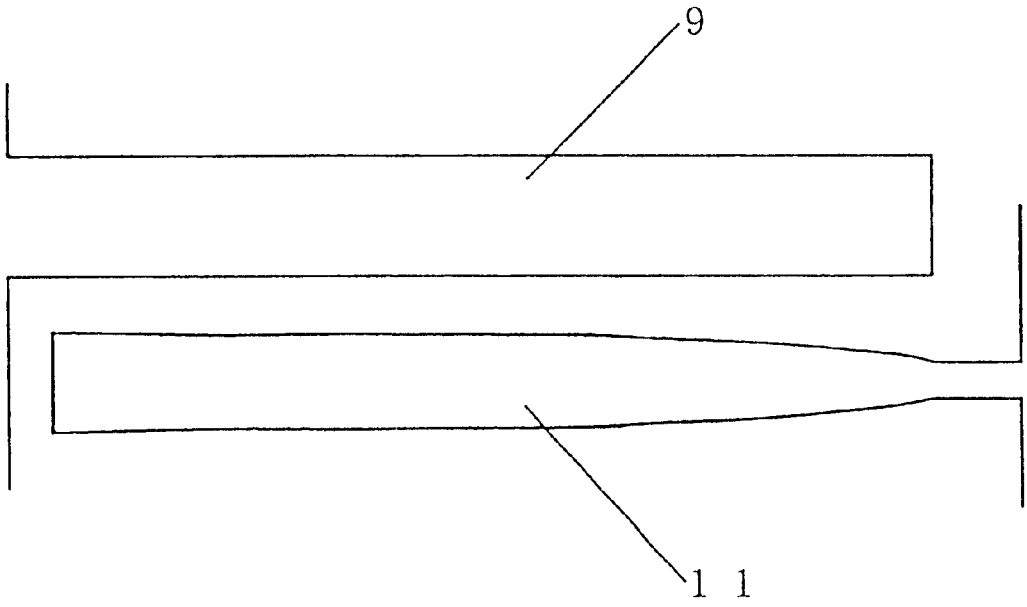
FIG. 2 is a diagram showing an arrangement of a second embodiment of the present invention.

Arrangements of first and second embodiments of the present invention are shown in FIGS. 1 and 2, respectively. In FIG. 1, each of upper and lower surfaces of the rotor blade 9 is contoured from the proximal end of the rotor blade 9 to the distal end thereof to present a flexure curve line expressed by Formula 1 or approximately expressed by Formula 1. In contrast, in FIG. 2, each of upper and lower surfaces of the stator blade 11 is contoured from the distal end of the stator blade 11 to the proximal end thereof to present a flexure curve line expressed by Formula 1 or approximately expressed by Formula 1.

Figure 3:
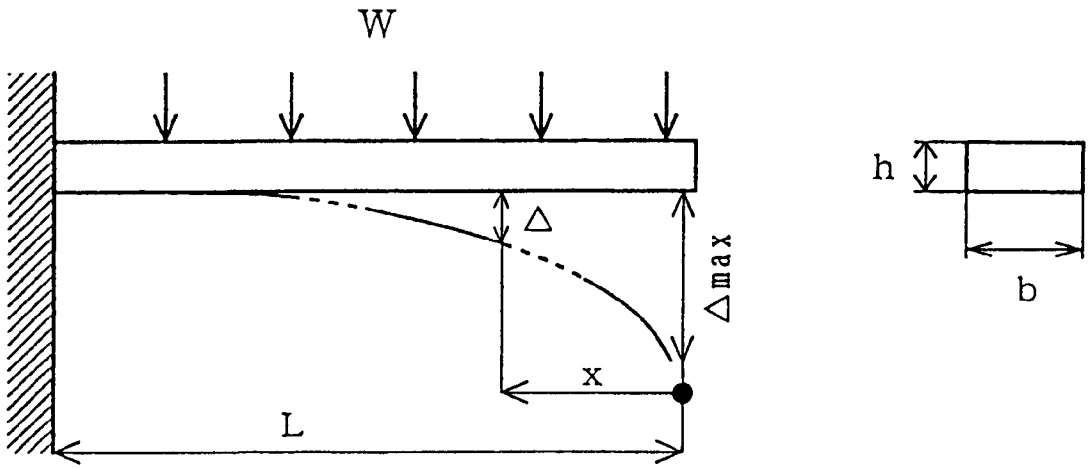
FIG. 3 is a diagram of a simple cantilever beam model for showing how a blade deflects.

Next, the operation of each of the first and second embodiments of the present invention will be described. To set the clearance δ between the rotor blade 9 and the stator blade 11 as small as possible, a consideration is given first to an effect caused by the flexure of the rotor blade 9 and the stator blade 11. It is assumed here that the blade is a simple cantilever beam having a rectangular cross section (height: h (mm), width: b (mm)) as shown in FIG. 3.

It is assumed further that the Young's modulus of the material is E (kgf/mm$^2$), the entire length of the beam is L (mm), and the force acts on the blade as an equally-distributed load W (kgf/mm) when a pressure difference is 1 atm. In this model, a flexure amount or deflection Δ (mm) at an arbitrary point x (mm) from the distal end of the blade to the proximal end thereof can be expressed by Formula 1. Here, the geometrical moment of inertia I (mm$^4$) possessed by the beam is expressed by Formula 3.

[Formula 3]

$$I = \frac{bh^3}{12} \qquad \text{[Formula 3]}$$

Figure 4:
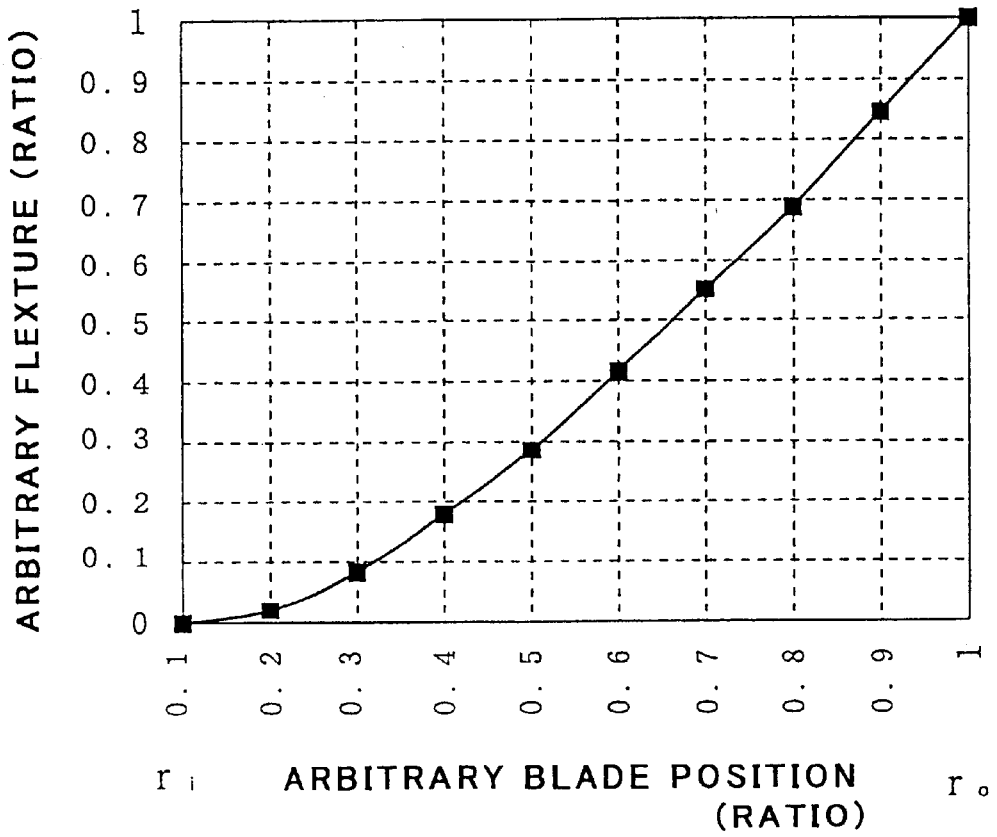
FIG. 4 is a diagram showing an amount of a deflection of a rotor blade based on a formula 1.

FIG. 4 shows the flexure amount or deflection of the rotor blade 9, which is obtained by being plotted on the basis of Formula 1. Note that values in FIG. 4 are dimensionless numbers since the entire blade length is assumed to be 1, and the flexure amount at the distal end of the blade is assumed to be 1. The clearance between the rotor blade 9 and the stator blade 11 is gradually enlarged from the proximal end of the rotor blade 9 to the distal end of the rotor blade 9 along the flexure curve line based on Formula 1. With this arrangement, it is possible to set the clearance between the rotor blade 9 and the stator blade 11 as small as possible while avoiding the contact between the rotor blade 9 and the stator blade 11.

To reduce the clearance δ, in the first embodiment of the present invention, the rotor blade 9 side is processed along this flexure curve line, whereas in the second embodiment, the stator blade 11 side is processed along this flexure curve line. Note that the former case that the rotor blade 9 side is processed is more advantageous over the latter case from the view point of the reliability since the former case is less flexured.

As a result, it is possible to maintain the reliability of a turbo molecular pump while enhancing the exhaust performance of the turbo molecular pump to such a degree as to correspond to an amount by which the clearance δ can be made small.

Figure 5:
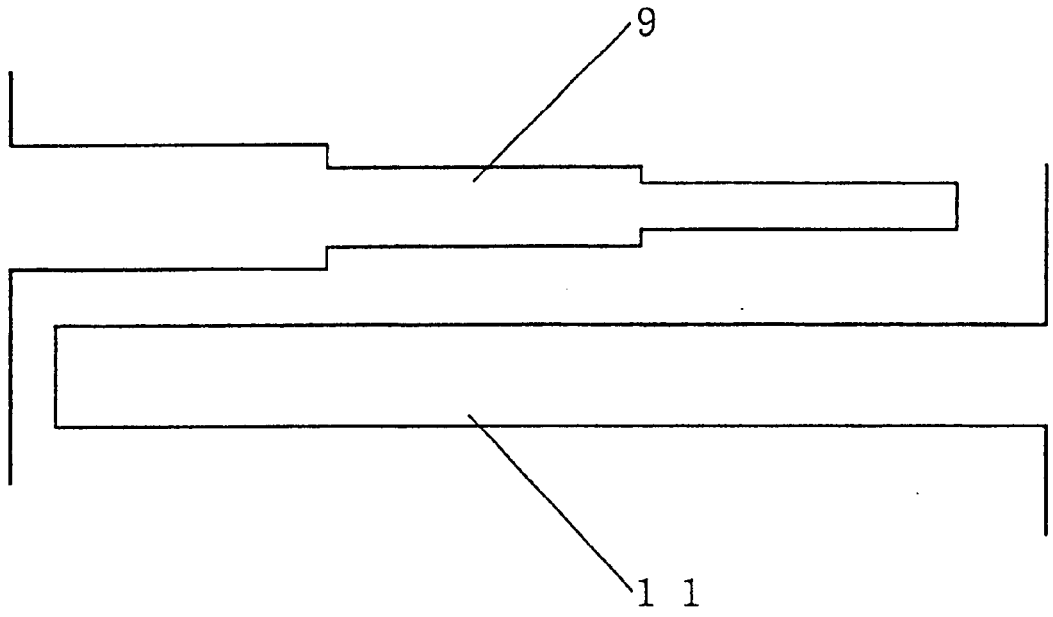
FIG. 5 is a diagram showing an arrangement of a third embodiment of the present invention.
Figure 6:
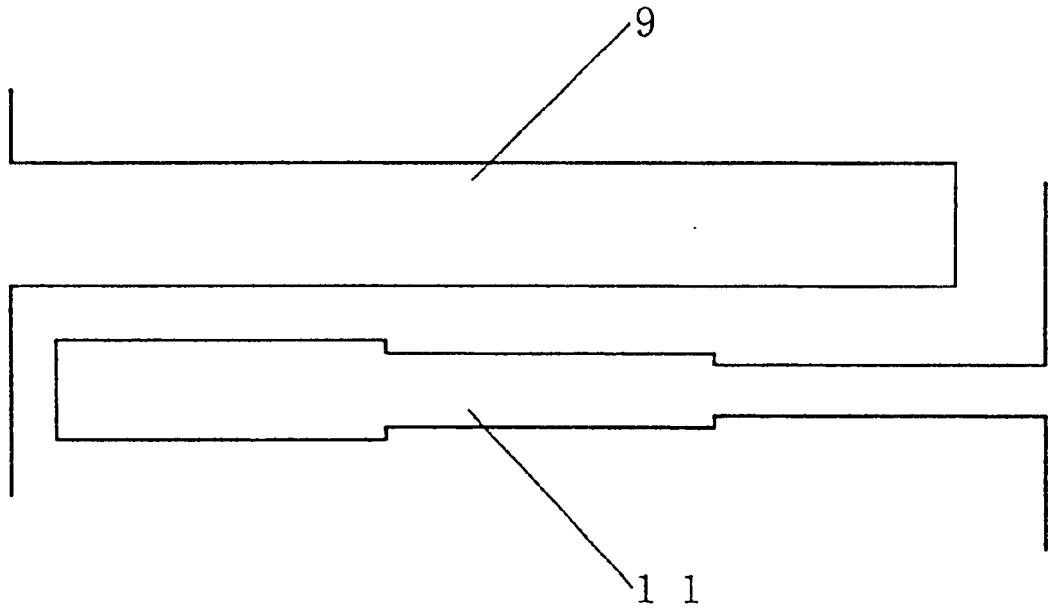
FIG. 6 is a diagram showing an arrangement of a fourth embodiment of the present invention.

Next, a third and fourth embodiments of the present invention will be described. FIG. 5 shows an arrangement of the third embodiment of the present invention, whereas FIG. 6 shows an arrangement of the fourth embodiment of the present invention.

In FIG. 5, each of the upper and lower surfaces of the rotor blade 9 is contoured in a three-stepwise manner to present, from the proximal end of the rotor blade 9 to the distal end thereof, a flexure curve line expressed by Formula 1 or approximately expressed by Formula 1. In contrast, in FIG. 6, each of the upper and lower surfaces of the stator blade 11 is contoured in a three-stepwise manner to present, from the distal end of the stator blade 11 to the proximal end thereof, a flexure curve line expressed by Formula 1 or approximately expressed by Formula 1.

Next, the operation of the third and fourth embodiments of the present invention will be described. The processing of the rotor blade 9 and the stator blade 11 along the flexure curve line as shown in FIGS. 1 and 2 is relatively difficult, which will result in a higher cost. Therefore, each of the upper and lower surfaces of the rotor blade 9 or the stator blade 11 is arranged in a stepwise manner to have a plurality of steps as shown in FIG. 5 or 6. In addition, from the viewpoint of avoiding the contact between the rotor blade 9 and the stator blade 11, it is preferable to process along the flexure curve line expressed by Formula 1 or approximately expressed by Formula 1 in the case where there are many steps.

Figure 7:
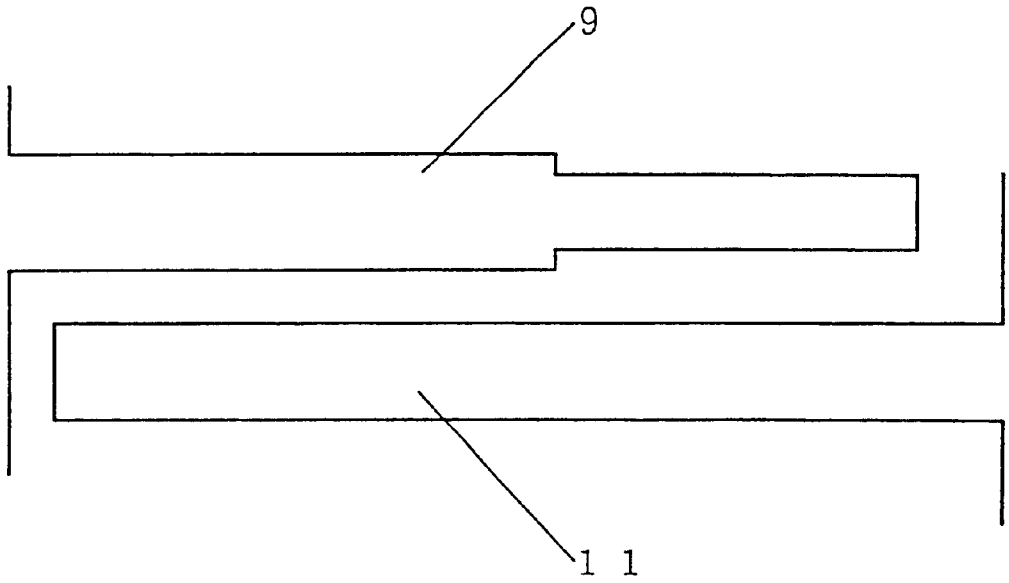
FIG. 7 is a diagram showing an arrangement of a fifth embodiment of the present invention.
Figure 8:
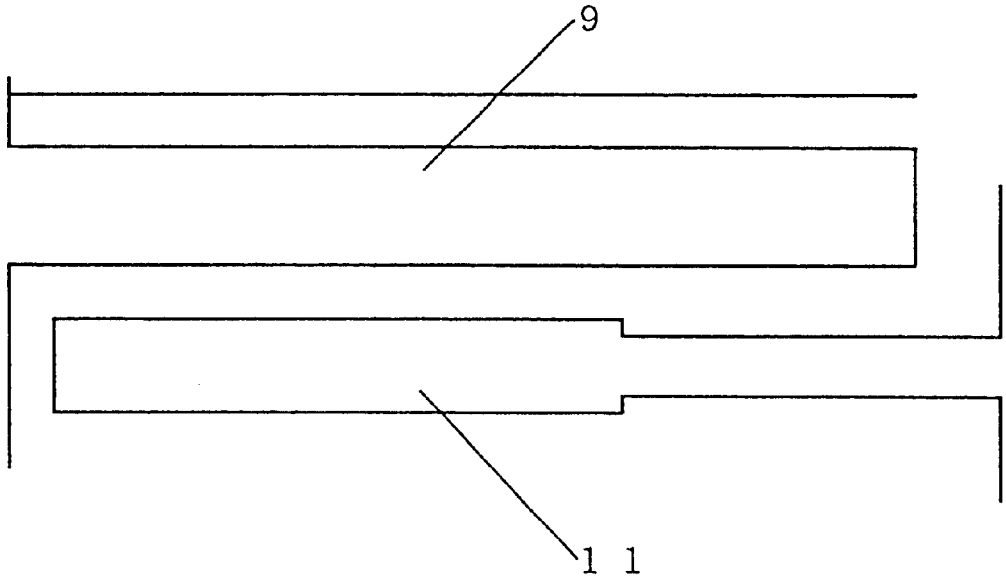
FIG. 8 is a diagram showing an arrangement of a sixth embodiment of the present invention.

Next, a fifth and sixth embodiments of the present invention will be described. FIG. 7 shows an arrangement of the fifth embodiment of the present invention, whereas FIG. 8 shows an arrangement of the sixth embodiment of the present invention.

In FIG. 7, each of the upper and lower surfaces of the rotor blade 9 has a single step located at a position 60% from the proximal end of the rotor blade 9 to the distal end thereof. In contrast, in FIG. 8, each of the upper and lower surfaces of the stator blade 11 has a single step located at a position 60% from the distal end of the stator blade 11 to the distal end thereof.

Next, the operation of the fifth and sixth embodiments of the present invention will be described. In order to facilitate the processing further more, only one step is formed on each of the upper and lower surfaces of the rotor blade 9 or the stator blade 11 in the fifth and sixth embodiments of the present invention.

Figure 9:
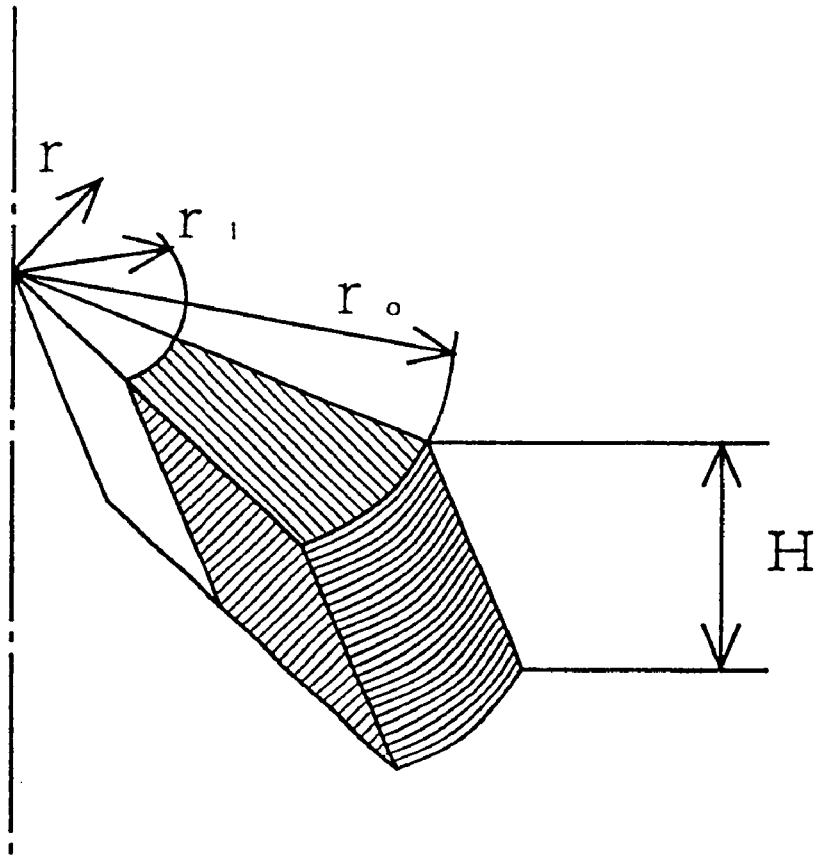
FIG. 9 is a diagram showing polar coordinates of a space disposed between blades.

The turbo molecular pump applies vector momentum to molecule of the gas existing between the rotor blade 9 and the stator blade 11, to thereby convey the molecule of the gas. FIG. 9 is polar coordinates showing a space disposed between the blades. The exhaust performance of the turbo molecular pump is inferred to have a correlation to the product of the volume of the object surrounded by hatched line in FIG. 9 with its equivalent mean circumferential velocity, which is expressed by Formula 4.

[Formula 4]

The exhaust performance of the turbo molecular pump by a blade

[Formula 4]

$$\begin{aligned}\text{The exhaust performance of the turbo molecular pump by a blade} &= \int_{ri}^{ro} 2\pi r \times r\omega \times dr \times H \\ &= 2\pi\omega H \int_{ri}^{ro} r^2\, dr \\ &= 2\pi\omega H\left(\frac{r_o^3 - r_i^3}{3}\right)\end{aligned}$$

Therefore, it is possible to compare the exhaust performances of the turbo molecular pumps on the basis of the values determined by Formula 4.

The character $r^i$ denotes a radius of a rotor 1, and the character $r_0$ denotes a length from a center of the rotor 1 to a distal end of the rotor blade 9. The character H denotes a height in the axial direction.

Figure 10:
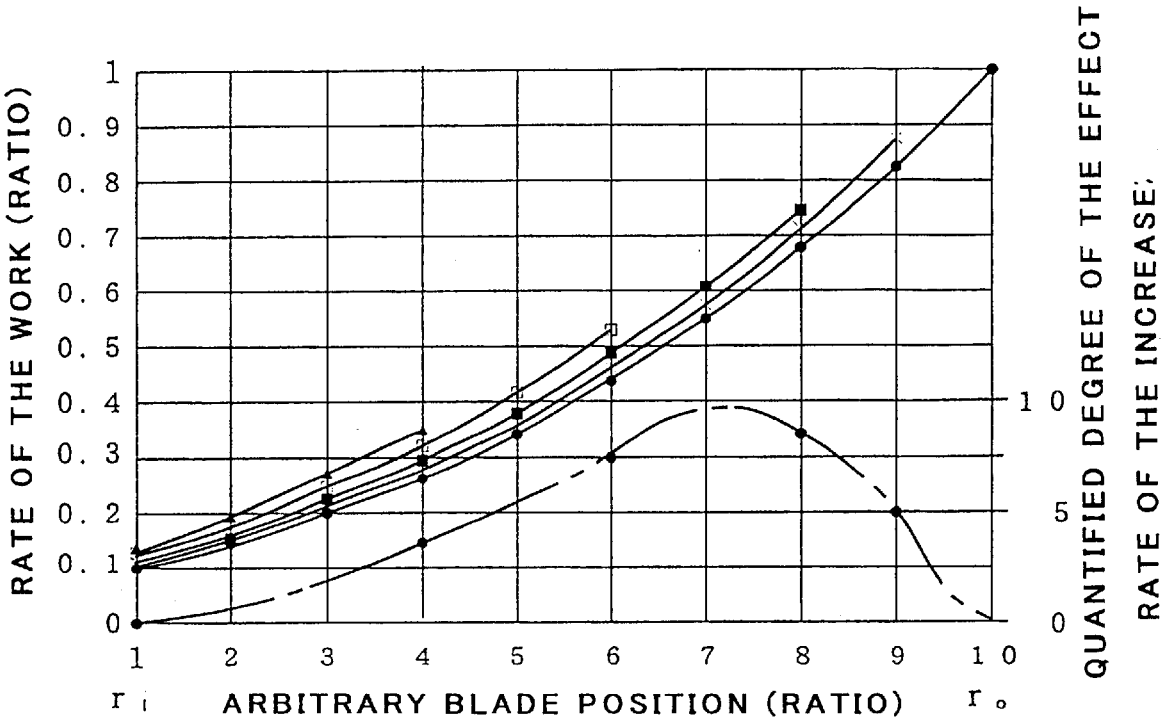
FIG. 10 is a diagram showing a work rate at an arbitrary position of a blade.

The solid line in FIG. 10 shows the work of the rotor blade 9 at an arbitrary position r which is expressed as dimensionless numbers by assuming the work at the distal end of the rotor blade 9 as 1. In FIG. 10, an arbitrary blade position (ratio) is shown as the x-coordinate, and a rate of the work (ratio) is shown as the y-coordinate.

The blade position is expressed as dimensionless numbers by assuming the position of $r_i$ that is the proximal end of the rotor blade 9 and the position of $r_0$ that is the distal end of the rotor blade 9 as 1 and 10, respectively. Since the work at the distal end is assumed to be 1 to express the work as the dimensionless numbers, the curve of work passes through a point ([x, y]=[10, 1]). Note that the exhaust performance of the turbo molecular pump by the entire length of the blade (i.e. the value expressed by Formula 4) corresponds to the area defined by a curve line passing through the points [1, 0.1] and [10, 1] in cooperation with the points [1, 0] and [10, 0].

Next, in order to provide a single step on the rotor blade 9, a consideration is given to an optimum position at which the step should be provided. First of all, an optimum clearance at a position at which this step is to be provided is set on the basis of Formula 1. Here, according to Formula 2, the performance in the intermediate flow region at the portion of the clearance δ is enhanced in an inverse-proportional manner. Also, a ratio of $r_i$: $r_0$ is assumed to be 1:2.5.

With respect to four typical examples where the single step is provided at a position 40%, 60%, 80% or 90% from the proximal end of the rotor blade 9 to the distal end thereof, the calculation is made on the exhaust performance of the turbo molecular pump using Formula 4 on the basis of the clearance δ obtained from the flexure curve line expressed by Formula 1. The four curve lines in FIG. 10, which are respectively extended up to the four points, represent the calculation results.

For example, upon comparison of a case in which the step is provided at the 80% position with a case in which no step is provided, it can be found out that the curve line is increased from the (8, 0.68) to (8, 0.75), and thus the exhaust performance is increased. The two-dotted chain line in FIG. 10 shows an amount of the increase in the exhaust performance (the amount of the increase is evaluated as an area), which is quantified. The degree of this effect is expressed as quantified values on a right-handed side of the graph in the y-axis direction.

It can be found out from FIG. 10 that there is an optimum position in a range of 60–85% in a case where a single step is provided. Consequently, it is possible to realize a small-size and high-performance turbo molecular pump while maintaining the reliability (the clearance δ is the same at a portion at which the contact is the most likely to occur due to the flexure). Further, the provision of only one step makes the processing easier in comparison with other solutions.

Figure 11:
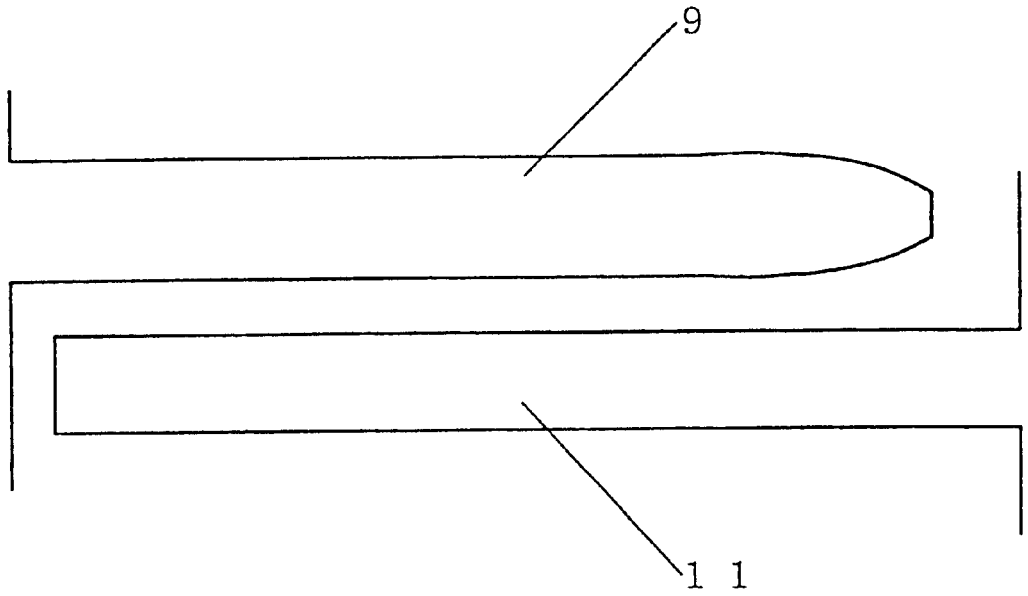
FIG. 11 is a diagram showing an arrangement of a seventh embodiment of the present invention.
Figure 12:
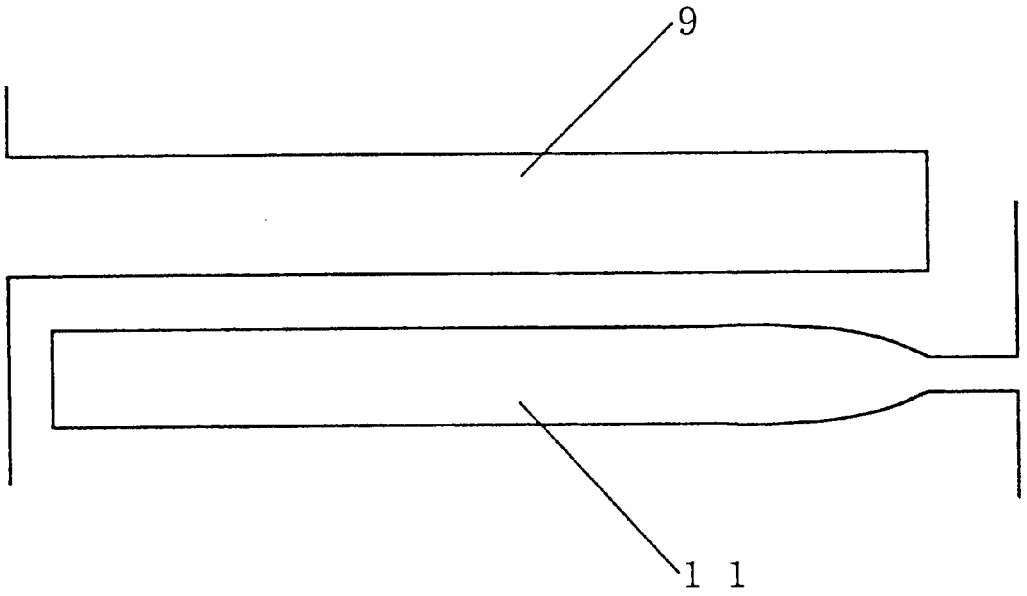
FIG. 12 is a diagram showing an arrangement of an eighth embodiment of the present invention.

Next, a seventh to fourteen embodiments of the present invention will be described. These are modifications of the first to sixth embodiments of the present invention. FIG. 11 shows an arrangement of the seventh embodiment of the present invention, and FIG. 12 shows an arrangement of the eighth embodiment of the present invention. In FIG. 11, the curve line processing is applied to the upper and lower surfaces of the rotor blade 9 from a portion of the rotor blade 9. In contrast, in FIG. 12, the curve line processing is applied to the upper and lower surfaces of the stator blade 11 from a portion of the stator blade 11.

Figure 13:
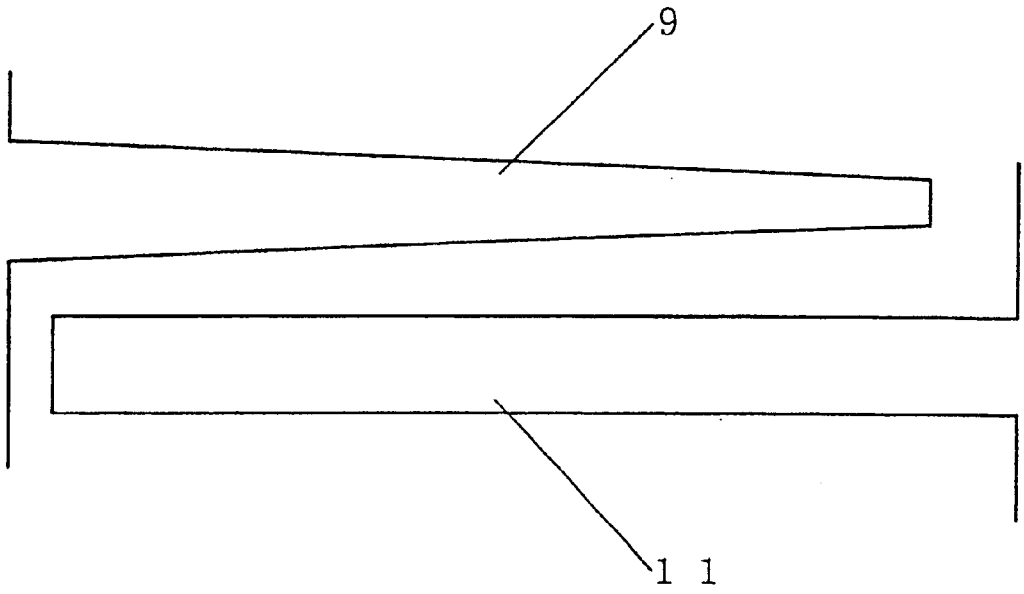
FIG. 13 is a diagram showing an arrangement of a ninth embodiment of the present invention.
Figure 14:
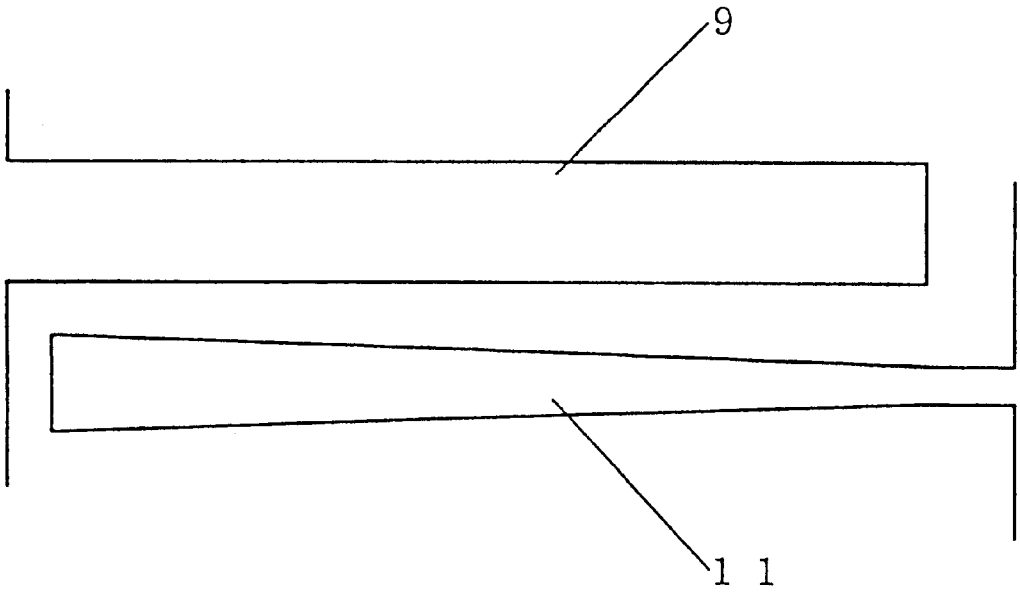
FIG. 14 is a diagram showing an arrangement of a tenth embodiment of the present invention.

FIG. 13 shows an arrangement of the ninth embodiment of the present invention, and FIG. 14 shows an arrangement of the tenth embodiment of the present invention. In FIG. 13, a tapered processing is applied to the upper and lower surfaces of the rotor blade 9. In contrast, in FIG. 14, the tapered processing is applied to the upper and lower surfaces of the stator blade 11.

Figure 15:
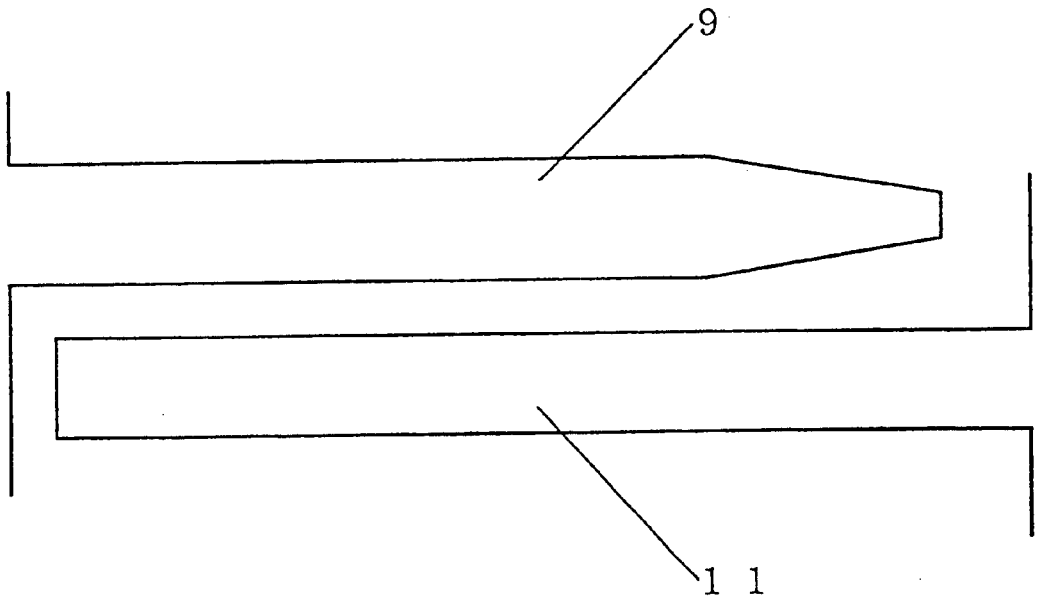
FIG. 15 is a diagram showing an arrangement of an eleventh embodiment of the present invention.
Figure 16:
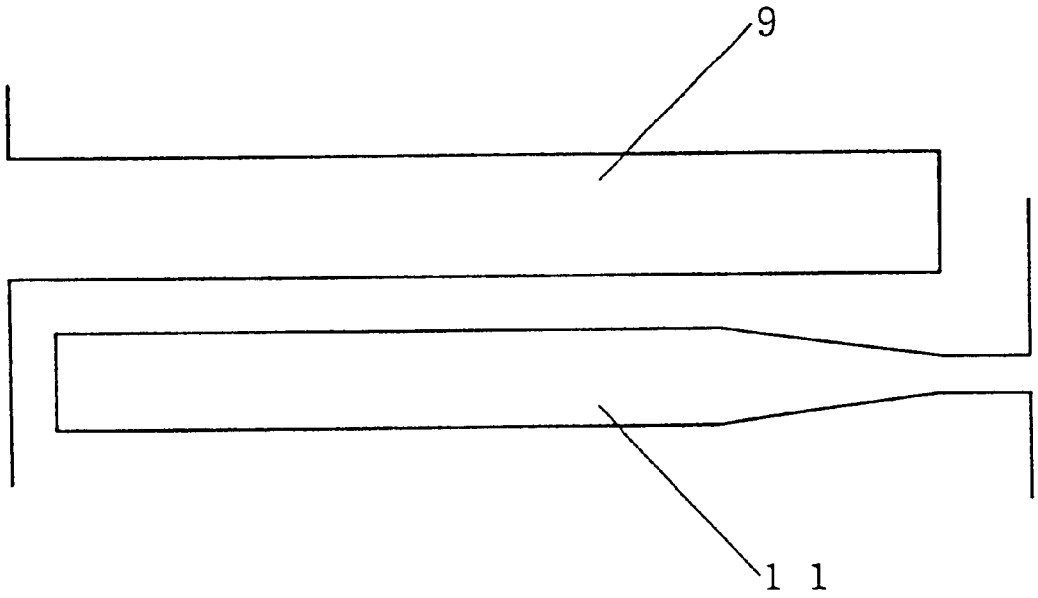
FIG. 16 is a diagram showing an arrangement of a twelfth embodiment of the present invention.

FIG. 15 shows an arrangement of the eleventh embodiment of the present invention, and FIG. 16 shows an arrangement of the twelfth embodiment of the present invention. In FIG. 15, the tapered processing is applied to the upper and lower surfaces of the rotor blade 9 from a portion of the rotor blade 9. In contrast, in FIG. 16, the tapered processing is applied to the upper and lower surfaces of the stator blade 11 from a portion of the stator blade 11.

Figure 17:
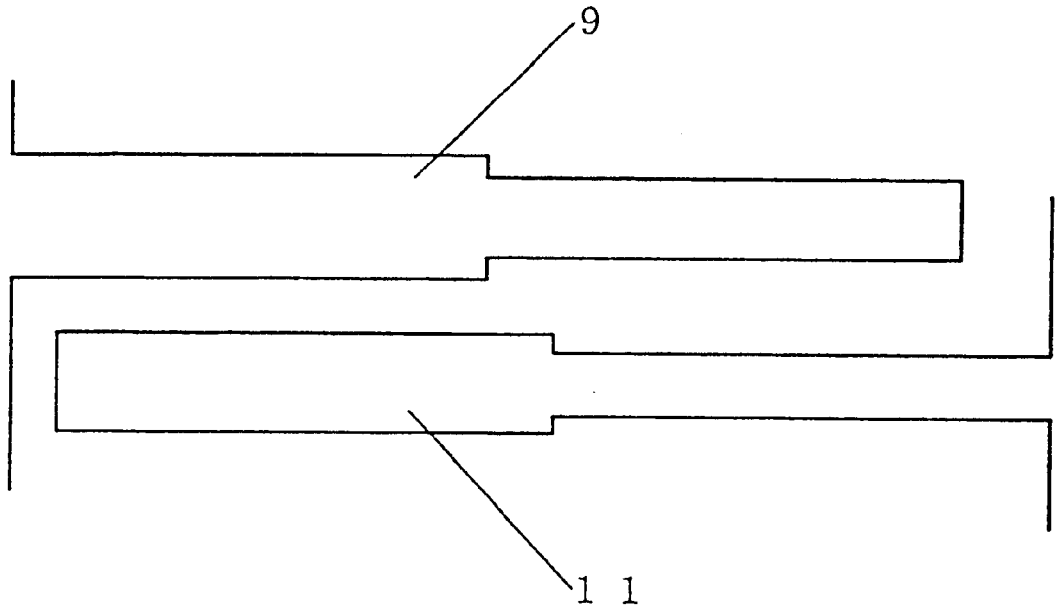
FIG. 17 is a diagram showing an arrangement of a thirteenth embodiment of the present invention.

FIG. 17 shows an arrangement of the thirteenth embodiment of the present invention. The embodiment shown in FIG. 17 is a combination of the fifth embodiment and the sixth embodiment of the present invention. This is not the sole case, and the embodiments described above may be combined in desired manners to form the rotor blade 9 and the stator blade 11.

Figure 18:
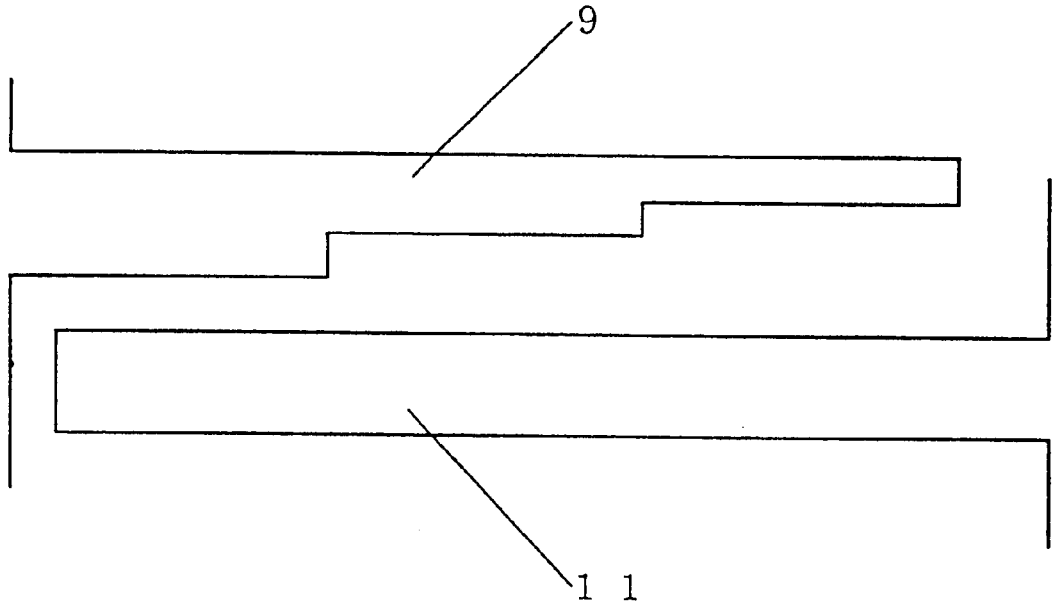
FIG. 18 is a diagram showing an arrangement of a fourteenth embodiment of the present invention.
Figure 19:
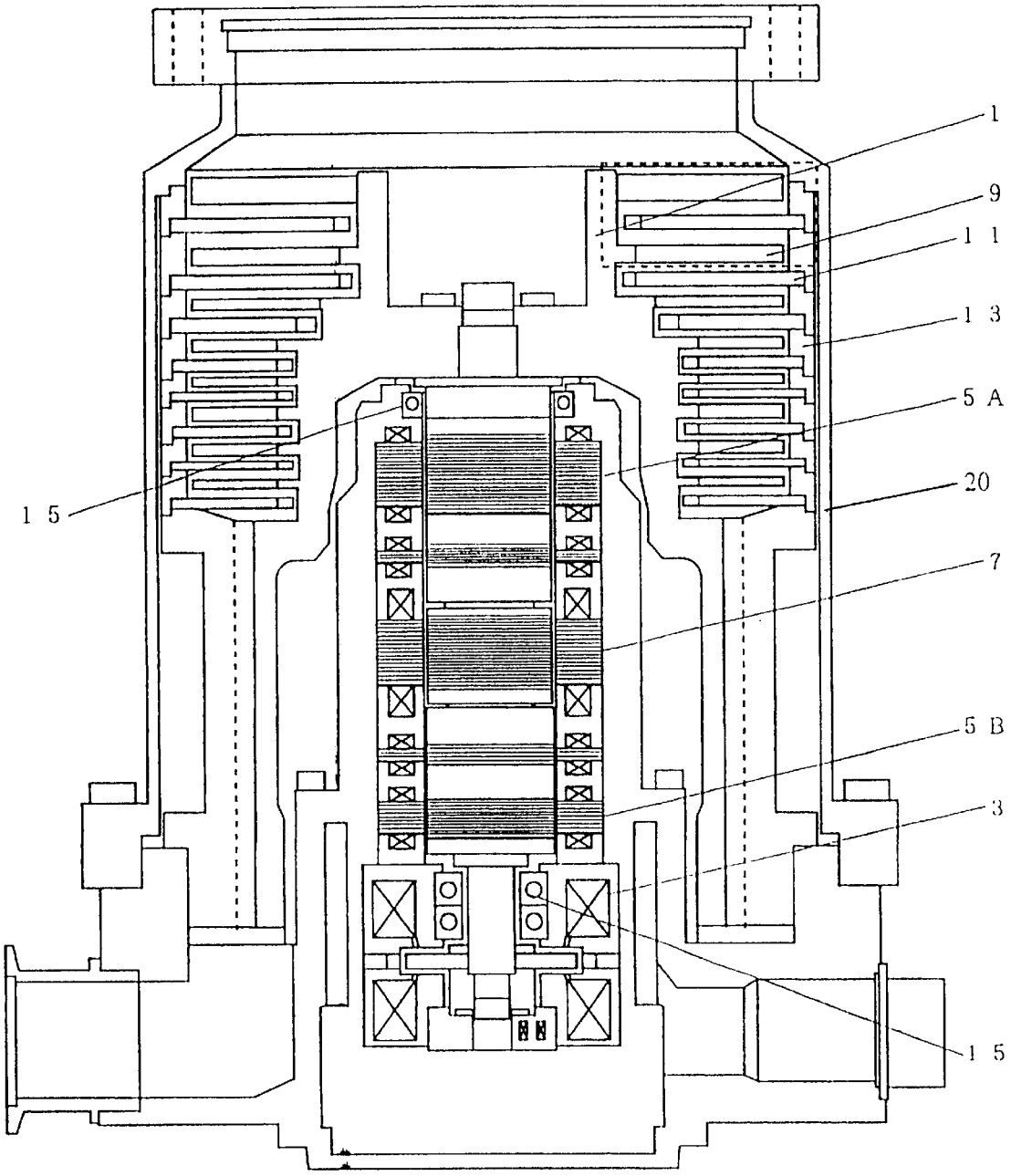
FIG. 19 is a diagram showing an entire arrangement of a turbo molecular pump.
Figure 20:
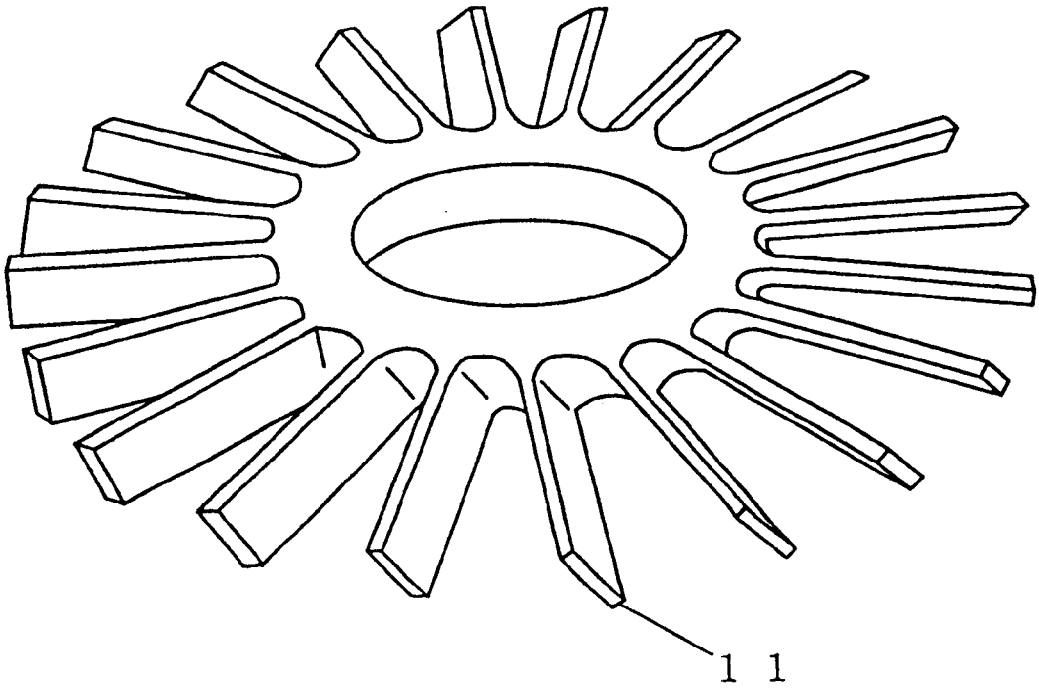
FIG. 20 is an external view of a stator blade.
Figure 21:
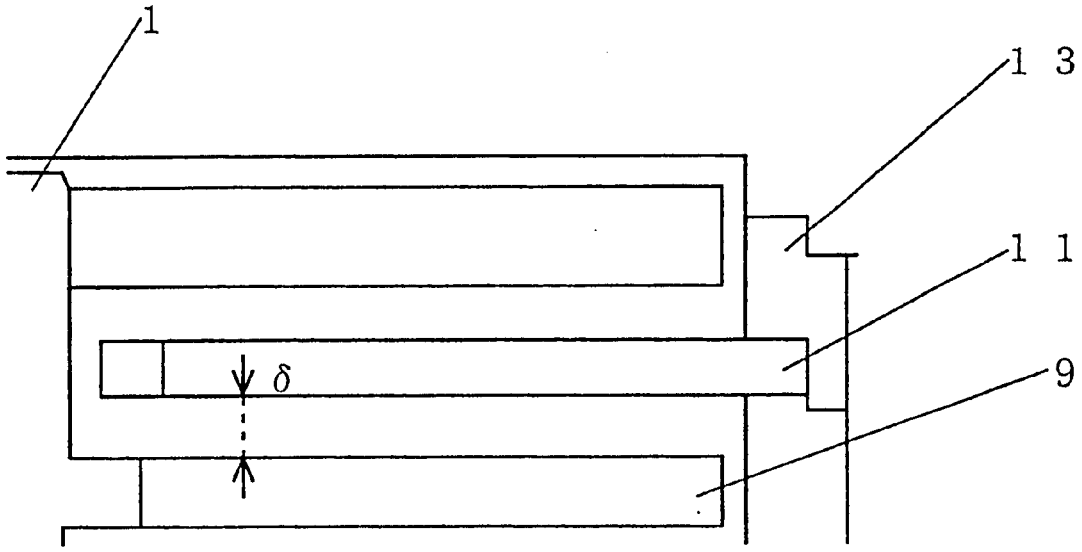
FIG. 21 is an enlarged view of a portion surrounded by a dotted frame in FIG. 19.
Figure 22:
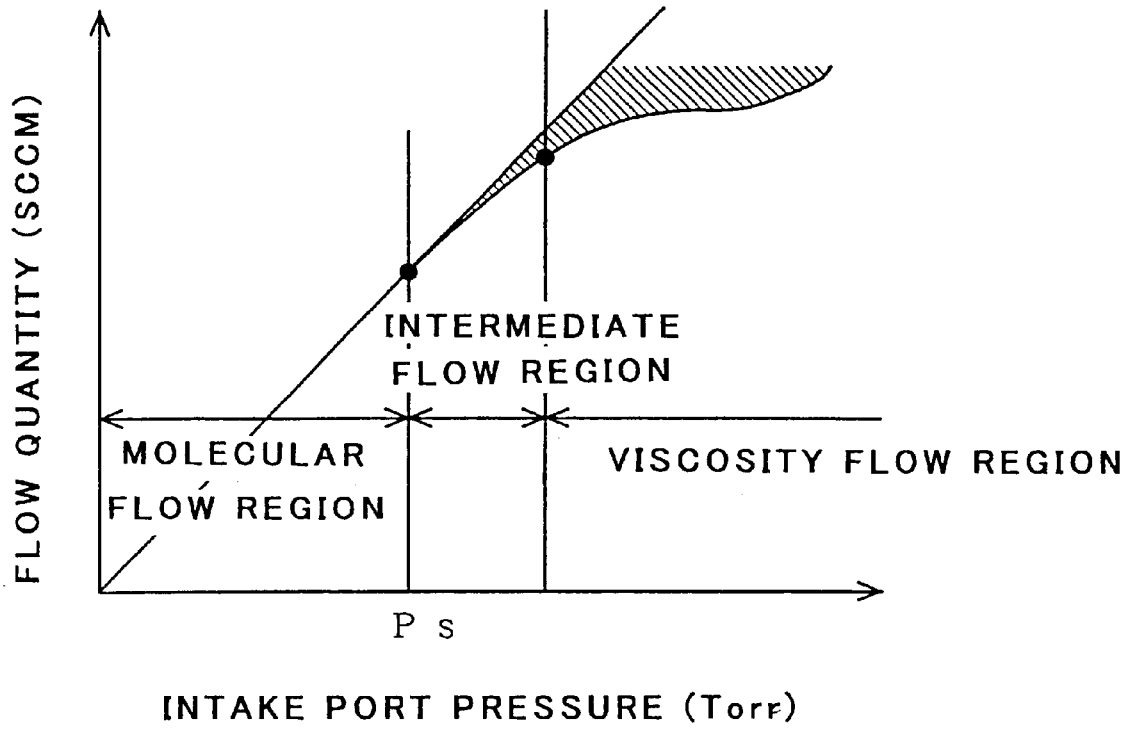
FIG. 22 is a diagram showing a relationship between an intake port pressure of a turbo molecular pump and a flow quantity.

FIG. 18 shows an arrangement of the fourteenth embodiment of the present invention. In FIG. 18, three steps are provided only on the lower surface of the rotor blades 9. This is not the sole case, and it goes without saying that a step or steps may be formed only on one of the upper and lower surfaces.

As described above, the arrangement or configuration in each of the seventh to fourteenth embodiments of the present invention can enhance the performance further more in comparison to the related art, and increase the reliability.

As described above, according to the present invention, a spatial clearance between the proximal end of a rotor blade and the distal end of a stator blade adjacent thereto is made smaller than a spatial clearance between the distal end of the rotor blade and the proximal end of the stator blade, to thereby enhance the exhaust performance in the case where the flow quantity is large.

What is claimed is:

1. A turbo molecular pump comprising: a rotor having rotor blades arranged in multiple stages, each of the rotor blades having a proximal end fixed to the rotor and a distal end; and stator blades arranged in multiple stages and each having a proximal end and a distal end, the rotor blades and the stator blades being alternately arranged in spaced-apart relation in an axial direction so that a spatial clearance between the proximal end of each of the rotor blades and the distal end of an adjacent stator blade is smaller than a spatial clearance between the distal end of each of the rotor blades and the proximal end of the adjacent stator blade; wherein each of the rotor blades comprises a cantilever member having upper and lower surfaces; and wherein at least one of the upper and lower surfaces of the cantilever member is contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and Δ represents a flexure amount of the cantilever member at a distance x (mm) from the distal end of the cantilever member.

2. A turbo molecular pump comprising: a rotor having rotor blades arranged in multiple stages, each of the rotor blades having a proximal end fixed to the rotor and a distal end; and stator blades arranged in multiple stages and each having a proximal end and a distal end, the rotor blades and the stator blades being alternately arranged in spaced-apart relation in an axial direction so that a spatial clearance between the proximal end of each of the rotor blades and the distal end of an adjacent stator blade is smaller than a spatial clearance between the distal end of each of the rotor blades and the proximal end of the adjacent stator blade; wherein each of the stator blades comprises a cantilever member having upper and lower surfaces; and wherein at least one of the upper and lower surfaces of the cantilever member is contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and Δ represents a flexure amount of the cantilever member at a distance x (mm) from a distal end of the cantilever member.

3. A turbo molecular pump comprising: a rotor having rotor blades arranged in multiple stages, each of the rotor blades having a proximal end fixed to the rotor and a distal end; and stator blades arranged in multiple stages and each having a proximal end and a distal end, the rotor blades and the stator blades being alternately arranged in spaced-apart relation in an axial direction so that a spatial clearance between the proximal end of each of the rotor blades and the distal end of an adjacent stator blade is smaller than a spatial clearance between the distal end of each of the rotor blades and the proximal end of the adjacent stator blade; wherein each of the rotor blades comprises a cantilever member having upper and lower surfaces; and wherein at least one of the upper and lower surfaces of the cantilever member has at least one step having a contour defining a flexure curve line represented by the formula $\Delta=(WL^4/8EI)(1-(4\times/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and Δ represents a flexure amount of the cantilever member at a distance x (mm) from a distal end of the cantilever member.

4. A turbo molecular pump according to claim 3; wherein the step is disposed at a position of the cantilever member in the range of 60–85% of the length L thereof as measured from the proximal end of the cantilever member.

5. A turbo molecular pump according to claim 3; wherein the at least one step of the cantilever member comprises a plurality of steps.

6. A turbo molecular pump according to claim 5; wherein at least one of the steps is disposed at a position of the cantilever member in the range of 60–85% of the length L thereof as measured from the proximal end of the cantilever member.

7. A turbo molecular pump comprising: a rotor having rotor blades arranged in multiple stages, each of the rotor blades having a proximal end fixed to the rotor and a distal end; and stator blades arranged in multiple stages and each having a proximal end and a distal end, the rotor blades and the stator blades being alternately arranged in spaced-apart relation in an axial direction so that a spatial clearance between the proximal end of each of the rotor blades and the distal end of an adjacent stator blade is smaller than a spatial clearance between the distal end of each of the rotor blades and the proximal end of the adjacent stator blade; wherein each of the stator blades comprises a cantilever member having upper and lower surfaces; and wherein at least one of the upper and lower surfaces of the cantilever member has at least one step having a contour defining a flexure curve line represented by the formula $\Delta=(WL^4/8EI)(1-(4\times/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and Δ represents a flexure amount of the cantilever member at a distance x (mm) from the distal end of the cantilever beam.

8. A turbo molecular pump according to claim 7; wherein the step is disposed at a position of the cantilever member in the range of 60–85% of the length L thereof as measured from the distal end of the cantilever member.

9. A turbo molecular pump according to claim 7; wherein the at least one step of the cantilever member comprises a plurality of steps.

10. A turbo molecular pump according to claim 9; wherein at least one of the steps is disposed at a position of the cantilever member in the range of 60–85% of the length L thereof as measured from the distal end of the cantilever member.

11. A turbo molecular pump comprising: a housing; a rotational shaft disposed in the housing for undergoing rotation relative to the housing about a rotational axis; a rotor mounted on the rotational shaft for rotation therewith; a plurality of rotor blades each having a first end fixed to the rotor and a second end; and a plurality of stator blades each having a first end fixed to the housing and a second end, the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein the rotor blades and the stator blades are contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and Δ represents a flexure amount of the cantilever member at a distance x (mm) from the second end of the cantilever member.

12. A turbo molecular pump comprising: a housing; a rotational shaft disposed in the housing for undergoing rotation relative to the housing about a rotational axis; a rotor mounted on the rotational shaft for rotation therewith; a plurality of rotor blades each having a first end fixed to the rotor and a second end; and a plurality of stator blades each having a first end fixed to the housing and a second end,the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein each of the stator blades comprises a cantilever member having upper and lower surfaces, at least one of the upper and lower surfaces having at least one step disposed at a position of the cantilever member in the range of 60–85% of a length thereof as measured from the second end of the cantilever member.

13. A turbo molecular pump comprising: a housing; a rotational shaft disposed in the housing for undergoing rotation relative to the housing about a rotational axis; a rotor mounted on the rotational shaft for rotation therewith;

a plurality of rotor blades each having a first end fixed to the rotor and a second end; and a plurality of stator blades each having a first end fixed to the housing and a second end, the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein each of the stator blades comprises a cantilever member having upper and lower surfaces, at least one of the upper and lower surfaces having at least one step having a contour defining a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and $\Delta$ represents a flexure amount of the cantilever member at a distance x (mm) from the second end of the cantilever member.

14. A turbo molecular pump comprising: a housing; a rotational shaft disposed in the housing for undergoing rotation relative to the housing about a rotational axis; a rotor mounted on the rotational shaft for rotation therewith; a plurality of rotor blades each having a first end fixed to the rotor and a second end; and a plurality of stator blades each having a first end fixed to the housing and a second end, the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein each of the stator blades comprises a cantilever member having upper and lower surfaces, at least one of the upper and lower surfaces having a plurality of steps.

15. A turbo molecular pump comprising: a housing; a rotational shaft disposed in the housing for undergoing rotation relative to the housing about a rotational axis; a rotor mounted on the rotational shaft for rotation therewith; a plurality of rotor blades each having a first end fixed to the rotor and a second end; and a plurality of stator blades each having a first end fixed to the housing and a second end, the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein each of the rotor blades comprises a cantilever member having upper and lower surfaces; and wherein at least one of the upper and lower surfaces of the cantilever member is contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and $\Delta$ represents a flexure amount of the cantilever member at a distance x (mm) from the second end of the cantilever member.

16. A turbo molecular pump comprising: a housing; a rotational shaft disposed in the housing for undergoing rotation relative to the housing about a rotational axis; a rotor mounted on the rotational shaft for rotation therewith; a plurality of rotor blades each having a first end fixed to the rotor and a second end; and a plurality of stator blades each having a first end fixed to the housing and a second end, the rotor blades and the stator blades being alternately arranged in spaced-apart relation in the direction of the rotational axis so that a distance between the first end of each of the rotor blades and the second end of an adjacent stator blade is smaller than a distance between the second end of each of the rotor blades and the first end of the adjacent stator blade; wherein each of the stator blades comprises a cantilever member having upper and lower surfaces; and wherein at least one of the upper and lower surfaces of the cantilever member is contoured to define a flexure curve line represented by the formula $\Delta=(WL^4/8EI)(1-(4X/3L)+(X^4/3L^4))$, where E (kgf/mm$^2$) represents the Young's modulus of the material of the cantilever member, I (mm$^4$) represents the geometrical moment of inertia of the cantilever member, L (mm) represents the length of the cantilever member, W (kgf/mm) represents a load distributed on the cantilever member, and $\Delta$ represents a flexure amount of the cantilever member at a distance x (mm) from the second end of the cantilever member.

* * * * *